US006799554B2

(12) United States Patent
Furuta

(10) Patent No.: US 6,799,554 B2
(45) Date of Patent: Oct. 5, 2004

(54) APPARATUS FOR CONTROLLING ELECTRONIC THROTTLE VALVE

(75) Inventor: Akira Furuta, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 68 days.

(21) Appl. No.: 10/287,473

(22) Filed: Nov. 5, 2002

(65) Prior Publication Data

US 2004/0000286 A1 Jan. 1, 2004

(30) Foreign Application Priority Data

Jun. 27, 2002 (JP) ..... 2002-187589

(51) Int. Cl.[7] ..... F02D 41/08
(52) U.S. Cl. ..... 123/350; 123/399; 123/339.14
(58) Field of Search ..... 123/350, 399, 123/361, 339.14, 339.25, 339.26; 701/103, 115; 73/118.2

(56) References Cited

U.S. PATENT DOCUMENTS 5,492,095 A * 2/1996 Hara et al. ..... 123/339.19
5,947,086 A * 9/1999 Hoshino et al. ..... 123/399
6,055,476 A * 4/2000 Yoshino ..... 701/110
6,109,239 A * 8/2000 Watanabe ..... 123/396
6,152,108 A * 11/2000 Adachi et al. ..... 123/399
6,182,635 B1 * 2/2001 Nishida ..... 123/399
6,202,628 B1 * 3/2001 Iwano et al. ..... 123/339.16
6,223,719 B1 * 5/2001 Yano et al. ..... 123/339.14
6,474,301 B1 * 11/2002 Kamimura et al. ..... 123/396
2003/0084873 A1 * 5/2003 Ishida et al. ..... 123/399

FOREIGN PATENT DOCUMENTS

JP 05-263703 10/1993
JP 62673 * 3/1999 ..... F02D/41/18

* cited by examiner

*Primary Examiner*—Hai Huynh
(74) *Attorney, Agent, or Firm*—Sughrue Mion, PLLC

(57) ABSTRACT

To provide an electronic throttle valve control apparatus which has a high throttle valve opening resolution, and which can be manufactured at a low cost. The apparatus for controlling an electronic throttle valve in which a throttle valve provided in a suction path of an engine is driven to be opened and closed by a motor, includes: a target throttle opening computation unit for computing a target throttle opening of the throttle valve; an actual throttle opening detector for detecting an actual opening of the throttle valve; a control-use actual throttle opening computation unit for computing a control-use actual throttle opening by adding a predetermined number of times the actual throttle opening detected value obtained by the actual throttle opening detector; and a throttle valve controller for controlling the throttle valve on the basis of an opening deviation between the target throttle opening and the control-use actual throttle opening.

5 Claims, 8 Drawing Sheets

APPARATUS FOR CONTROLLING ELECTRONIC THROTTLE VALVE

BACKGROUND OF THE INVENTION

1. Field of the Invention

The present invention relates to an apparatus for controlling an electronic throttle valve in which a throttle valve provided in a suction path of an engine is driven to be opened and closed by a motor, and more particularly, to an electronic throttle control suitable for throttle opening control at a small opening.

2. Description of the Related Art

There have recently been active movements toward realization of constant-speed cruise control, traction control and lean-burn control based on electronic control of a throttle valve. While specially-designed idle speed control (ISC) valves have heretofore been used for ISC control because of the need for performing throttle valve control for positioning with high accuracy, a method of performing ISC control using an electronically-controlled throttle has been conceived as a method enabling ISC control without using a specially-designed ISC valve. However, there is a need for accurate control at a small throttle valve opening since the air flow rate during idling is low.

Ordinarily, a throttle valve opening sensor for obtaining information on the throttle valve opening is used to indicate information from the completely closed state to the fully opened state through the output in a range from 0 to 5 V. For this reason, means for changing the accuracy of an A/D converter used in combination with a microcomputer or changing the characteristics of a throttle valve opening sensor and a throttle valve opening sensor input circuit have been devised to improve the control resolution of the throttle valve opening.

For example, in the art disclosed in JP 5-263703 A, two A/D converters are used to detect the throttle valve opening. The output from a throttle valve opening sensor is directly input to one of the two A/D converters, while the output from the throttle valve opening sensor is amplified before being input to the A/D converter. When higher accuracy is required in low-opening control such as ISC control, the amplified input from the throttle valve opening sensor is employed. The direct input is employed when the opening is large, that is, when the necessary accuracy is not so high. ISC control is thus realized.

To improve the control accuracy of the throttle valve opening, a system such as that described above is required which has a throttle valve opening sensor input circuit, two A/D converters, and a signal amplifier, and there is therefore a problem of increase in costs for manufacturing a control apparatus having such components.

SUMMARY OF THE INVENTION

In view of the above-described circumstances, an object of the present invention is therefore to provide an electronic throttle valve control apparatus which has a high throttle valve opening resolution, and which can be manufactured at a low cost.

In order to achieve the above-mentioned object, according to the present invention, there is provided an apparatus for controlling an electronic throttle valve in which a throttle valve provided in a suction path of an engine is driven to be opened and closed by a motor, said apparatus including: a target throttle opening computation unit for computing a target throttle opening of the throttle valve; an actual throttle opening detector for detecting an actual opening of the throttle valve; a control-use actual throttle opening computation unit for computing a control-use actual throttle opening by adding a predetermined number of times the actual throttle opening detected value obtained by said actual throttle opening detector; and a throttle valve controller for controlling the throttle valve on the basis of an opening deviation between the target throttle opening and the control-use actual throttle opening.

DETAILED DESCRIPTION OF THE PREFERRED EMBODIMENTS

Figure 1:
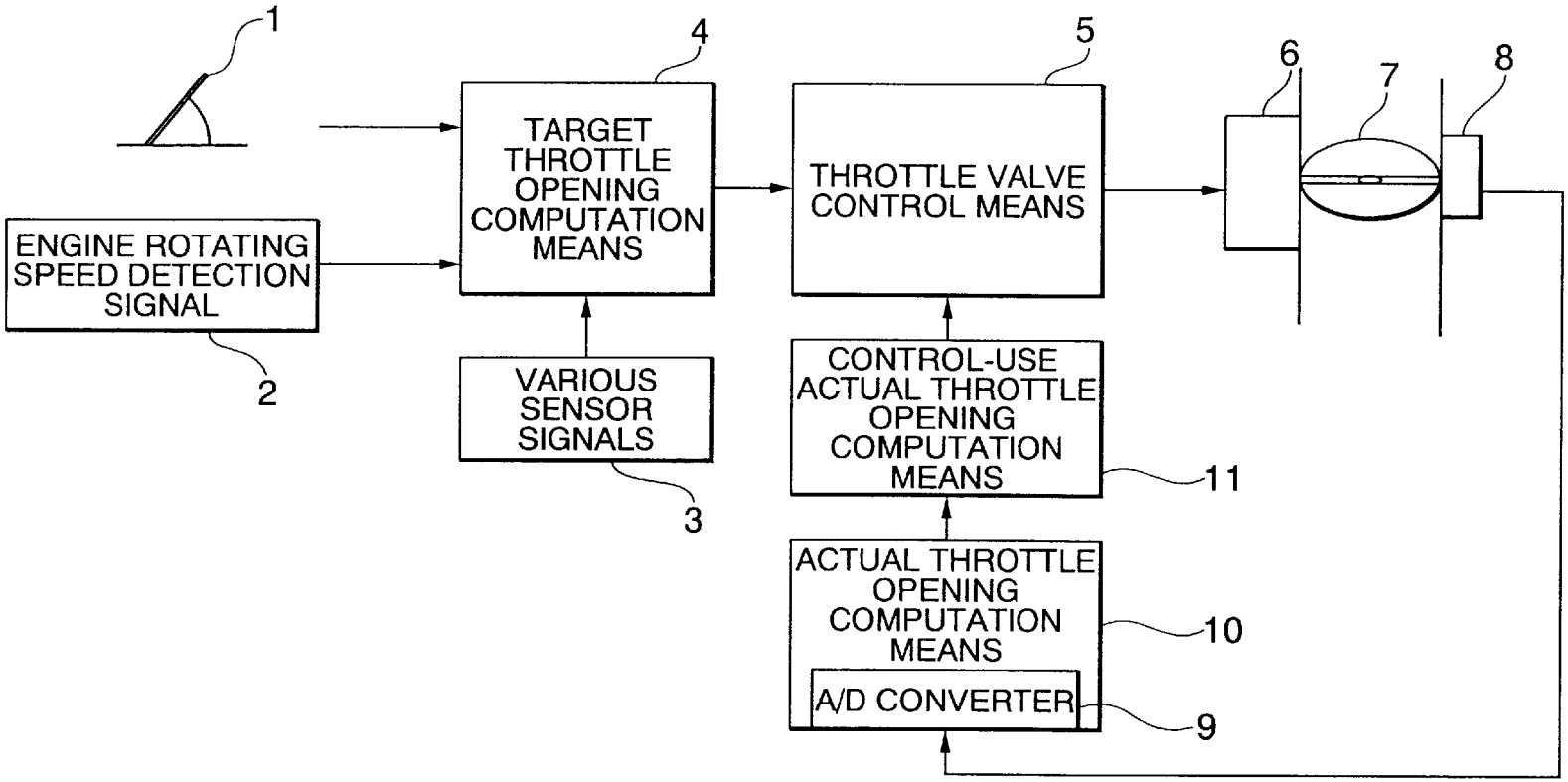
FIG. 1 is a block diagram showing an electronic throttle valve control apparatus in accordance with an embodiment of the present invention.

An embodiment of the present invention will be described with reference to the accompanying drawings. FIG. 1 is a block diagram showing an electronic throttle valve control apparatus in accordance with an embodiment of the present invention. The electronic throttle valve is constituted by a motor 6, a throttle valve 7, and an actual throttle opening sensor 8 for detecting an opening of the throttle valve 7. Target throttle opening computation means 4 for computing a target opening of the throttle valve is supplied with an accelerator opening signal 1 indicating an accelerator operation performed by a driver, an engine speed detection signal indicating the engine rotating speed, and signals from various sensors 3 indicating conditions in the engine. The target throttle opening computation means 4 computes a target throttle opening of the electronic throttle valve on the basis of these various input signals.

Actual throttle opening detection means 10 makes analog-to-digital (A/D) conversion of the signal input from the actual throttle opening sensor 8 to an A/D converter 9 at certain time intervals, and computes an actual throttle opening from the converted signal. Control-use actual throttle opening computation means 11 computes an actual throttle opening used for control (hereinafter referred to as "control-use actual throttle opening") by adding a certain number of times and at certain time intervals the actual throttle opening computed by the actual throttle opening computation means 10.

Throttle valve control means 5 computes by PID control or the like an amount of control (e.g., a duty) of the throttle valve opening such that the target throttle opening and the actual throttle opening coincide with each other from the target throttle opening computed by the target throttle opening computation means 4 and the control-use actual throttle opening computed by the control-use actual throttle opening computation means 11. The motor 6 is controlled by this amount of control in driving the throttle valve 7.

Figure 2:
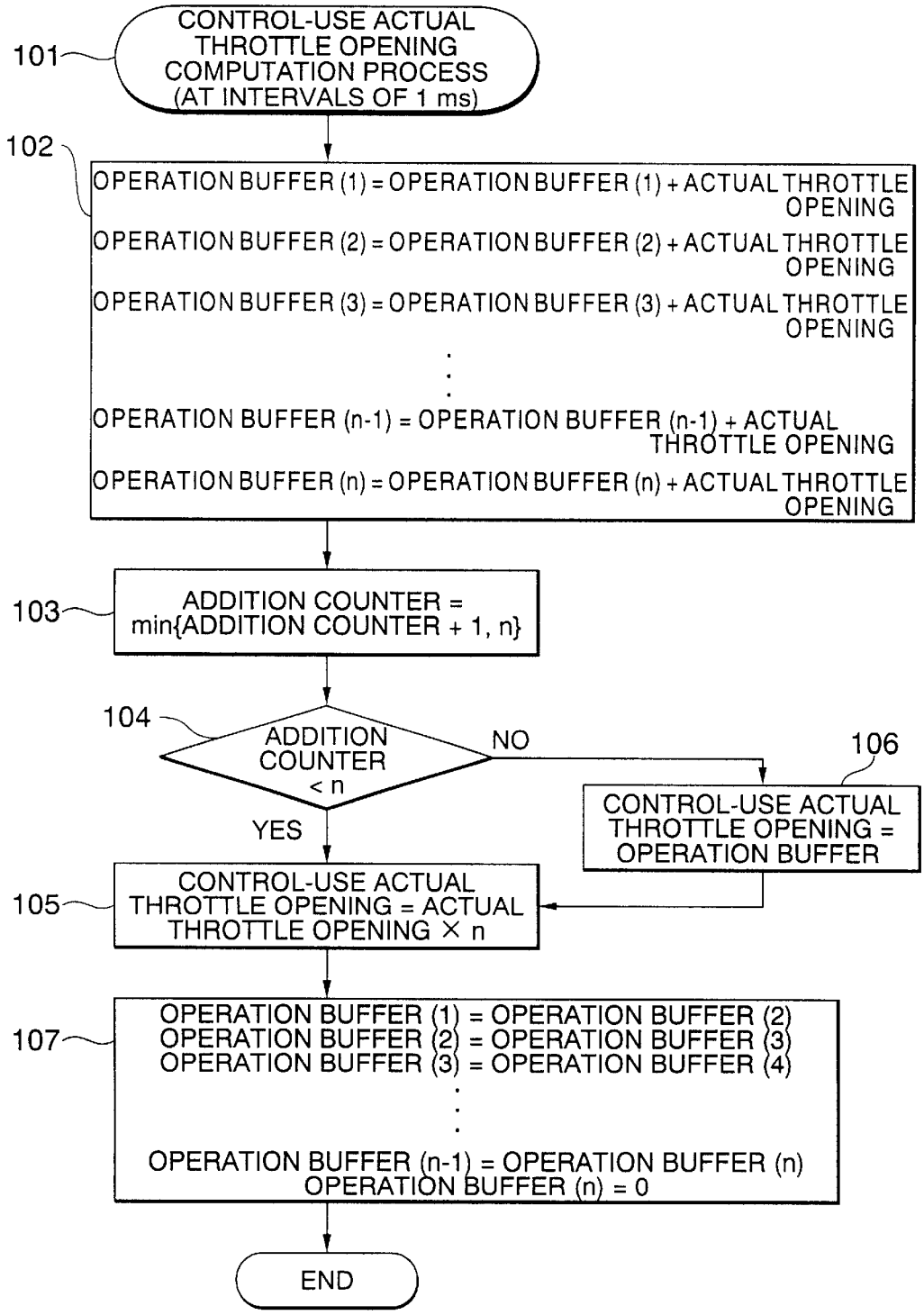
FIG. 2 is a flowchart of a control-use actual throttle opening computation process in accordance with the embodiment of the invention.

FIG. 2 is a flowchart showing computational operations performed by the control-use actual throttle opening computation means 11. This flowchart shows an example of a process in which a control-use actual throttle opening is computed by adding n number of times the actual throttle opening computed by the actual throttle opening computation means 10. Processing in step 101 for computation of a control-use actual throttle opening is executed at time intervals of 1 ms for example.

Figure 3:
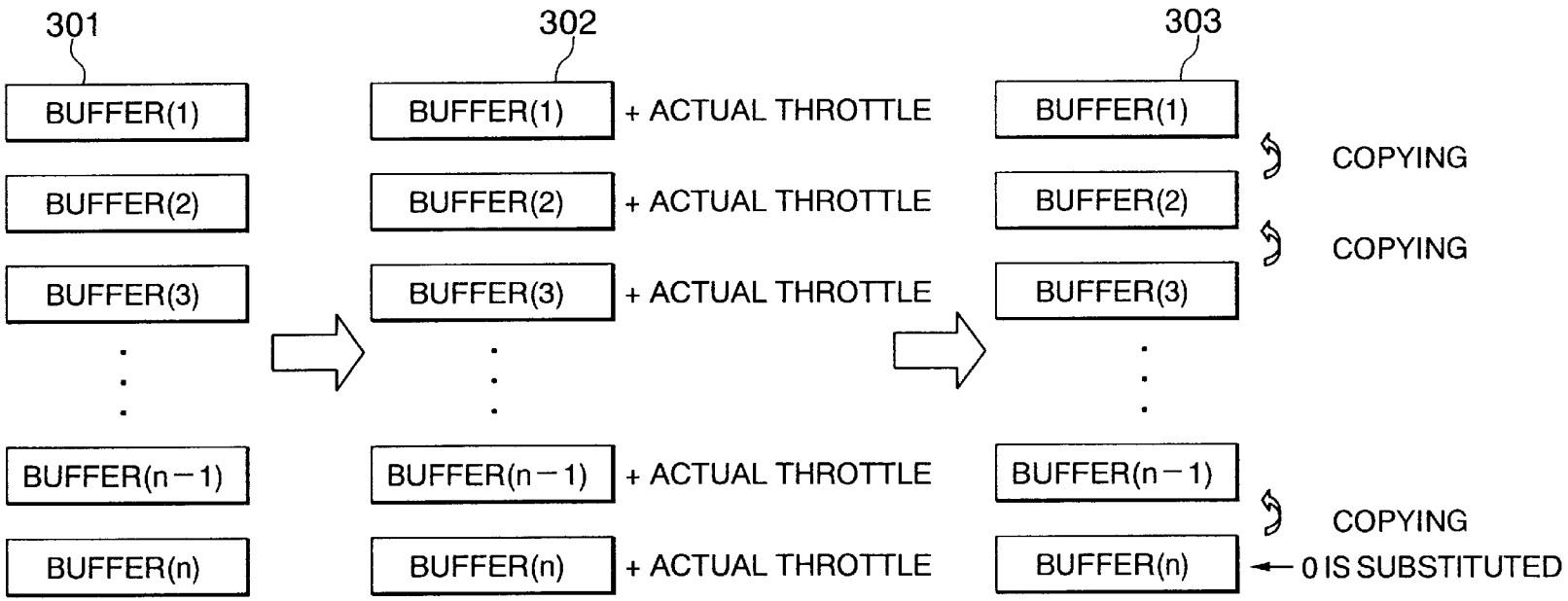
FIG. 3 is a diagram for explaining buffer data processing in the control-use actual throttle opening computation process in accordance with the embodiment of the invention.

To enable the control-use actual throttle opening computation process, there are prepared n computation buffers (1) to (n), such as those indicated by reference numeral 301 in FIG. 3, corresponding to the number of times the actual throttle opening is added. An addition counter capable of counting the number of times the actual throttle opening is added is also prepared. Each operation buffer and the addition counter are first cleared to zero at the time of CPU reset.

In step 102 shown in the flowchart of FIG. 2, the actual throttle opening obtained by the actual throttle opening computation processing is added in each of the operation buffers (1) to (n). This operation is also indicated by reference numeral 302 in FIG. 3.

In step 103, 1 is added to the value in the addition counter and 1 is added n times. The addition counter is clipped when the addition is repeated n times. By this processing, the addition counter indicating the number of times the actual throttle opening is added starts counting from zero at the time of CPU reset and is clipped when the addition is repeated n times.

The process thereafter advances to step 104, in which a determination is made as to whether the value in the addition counter counting the number of times the actual throttle opening is added is smaller than n. If the addition counter value is smaller than n, the process advances to step 105 and the value obtained by multiplying by n the actual throttle opening obtained by actual throttle opening computation processing is stored as a control-use actual throttle opening. If it is determined in step 104 that the addition counter value is equal to or larger than n, the value in the operation buffer (1) is stored as a control-use actual throttle opening in step 106.

Thereafter, in step 107, the value in the operation buffer (2) is copied to the operation buffer (1), the value in the operation buffer (3) is then copied to the operation buffer (2), . . . , the value in the operation buffer (n) is finally copied to the operation buffer (n−1), and the operation buffer (n) is cleared to zero. This operation is also indicated by reference numeral 303 in FIG. 3.

In this control-use actual throttle opening computation process, when the number of times the actual throttle opening is added after a CPU reset is smaller than n, not the actual throttle opening added up but the value obtained by multiplying by n the actual throttle opening currently obtained by actual throttle opening computation processing is used as a control-use actual throttle opening.

This is because a target throttle opening is computed by considering addition of the actual throttle opening performed n times, and because the amount of control of the motor should be computed without a disparity between LSBs. After the number of times the actual throttle opening is added has becomes equal to n, the operation buffer (1) maintains the value obtained by adding the actual throttle opening n times, and the value in the operation buffer (1) is used as a control-use actual throttle opening.

Figure 4:
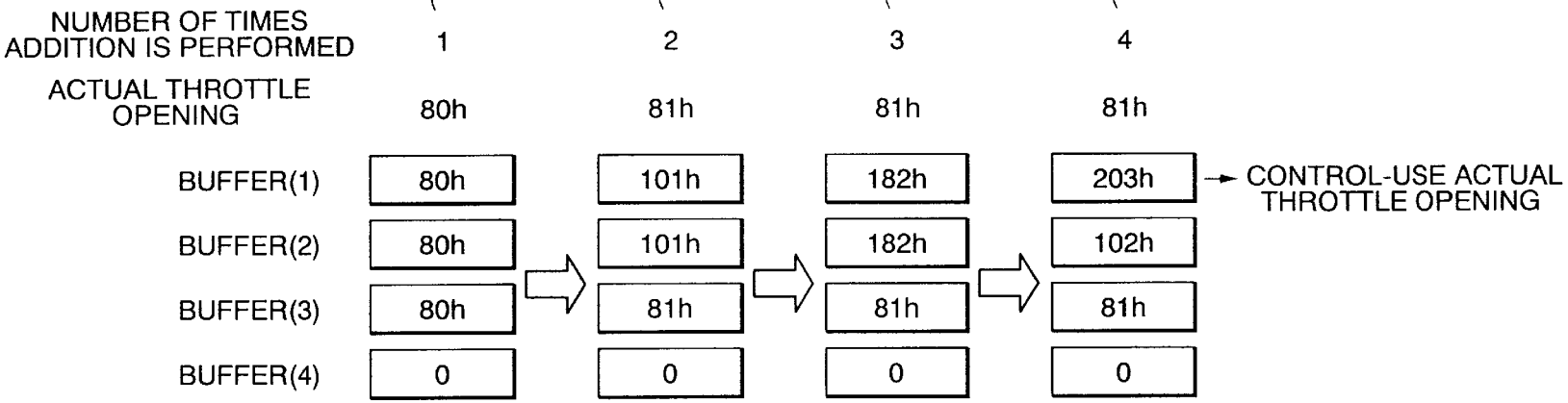
FIG. 4 is a diagram showing an example of adding actual throttle opening data four times in accordance with the embodiment of the invention.

FIG. 4 shows data computed as control-use actual throttle opening values in a case where the number of times the actual throttle opening is added is set to 4 in the control-use actual throttle opening computation means 11. It is also assumed that the resolution of the A/D converter 9 is 8 bits, the actual throttle opening obtained by a first addition is 80*h*, and the actual throttle opening obtained by each of second to fourth additions is 81*h*.

The states of the operation buffers indicated by reference numeral 401 in FIG. 4 are the results of the steps corresponding to those in the flowchart of FIG. 2 showing the control-use actual throttle opening computation process, i.e., adding the actual throttle opening *80*h in each of the operation buffers (1) to (4), performing copying from the operation buffer (2) to the operation buffer (1), from operation buffer (3) to the operation buffer (2), and from the operation buffer (4) to the operation buffer (3), and finally clearing the operation buffer (4) to zero.

The states of the operation buffers indicated by reference numeral 402 are the results of the steps of adding after 1 ms the actual throttle opening 81*h* in the operation buffers in the states indicated by reference numeral 401, performing copying from the operation buffer (2) to the operation buffer (1), from operation buffer (3) to the operation buffer (2), and from the operation buffer (4) to the operation buffer (3), and finally clearing the operation buffer (4) to zero.

The states of the operation buffers indicated by reference numeral 403 are the results of the third addition of the actual throttle opening 81*h* after a further lapse of 1 ms, and the states of the operation buffers indicated by reference numeral 404 are the results of the fourth addition of the actual throttle opening 81*h*. By the fourth addition of the actual throttle opening indicated by reference numeral 404, a computed value 203*h* of a 10 bit length in the operation buffer (1) is obtained as the control-use actual throttle opening.

Figure 5:
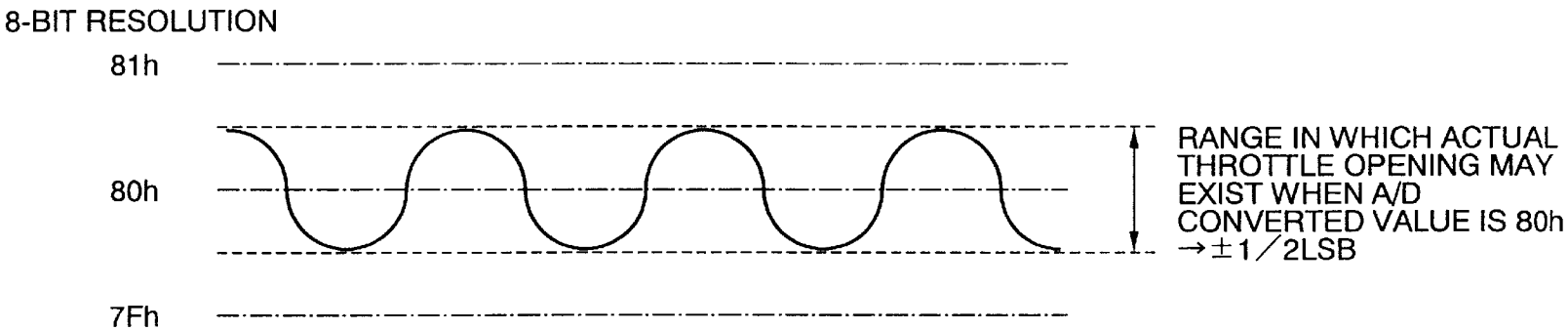
FIG. 5 is a diagram showing a range in which the actual throttle opening exists in the case of a 8-bit resolution and 80*h* in accordance with the embodiment of the invention.

FIG. 5 shows the range in which the actual throttle opening exists in the case where the resolution of the A/D converter 9 is 8 bits, and where the actual throttle opening A/D converted and computed by the actual throttle opening computation means 10 is 80*h*. Dot-dash lines indicate, in order from above, the opening values 81*h*, 80*h*, and 7Fh based on the 8-bit resolution, and broken lines indicate the range in which the actual throttle opening exists when the A/D converted value is 80*h*. Values to be determined are within ±½ LSB according to a characteristic of the A/D converter. Ordinarily, the A/D converter 9 of a higher resolution is required if it is necessary to confirm which point in the range between the broken lines the actual throttle opening exists.

Figure 6:
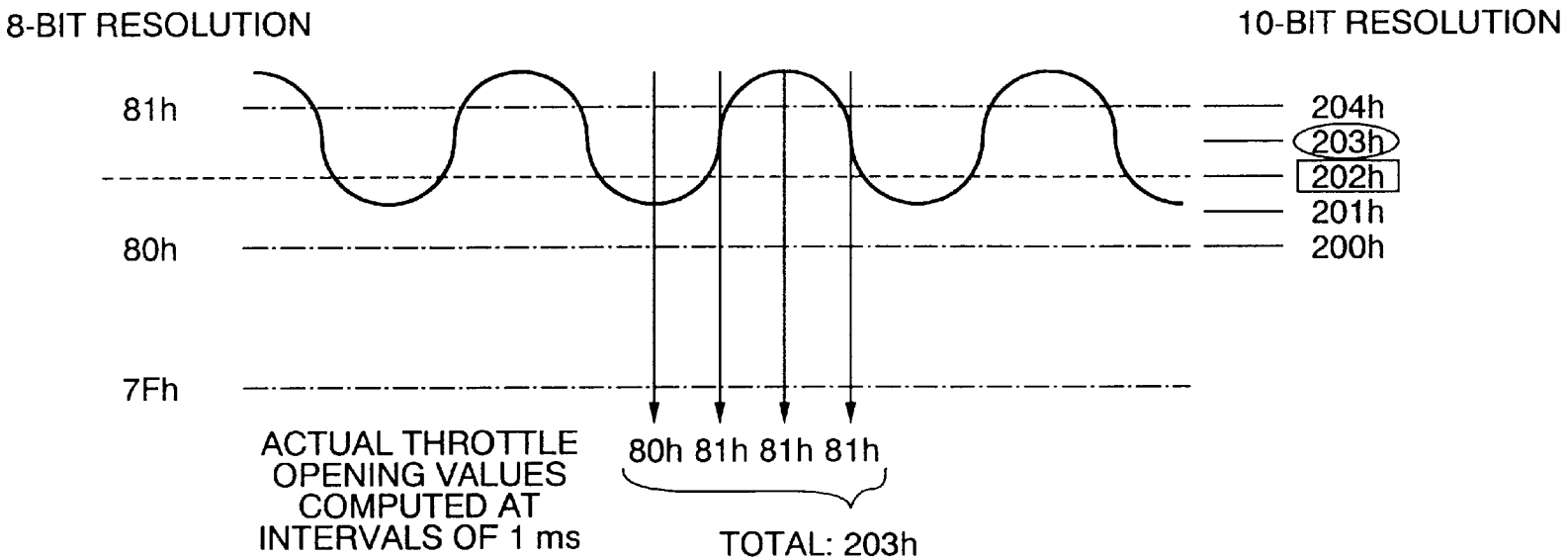
FIG. 6 is a diagram showing supposed points of the actual throttle opening in the case of processing shown in FIG. 4 in accordance with the embodiment of the invention.

In a case of the actual throttle opening data shown in FIG. 4, it is however possible to suppose a point representing the actual throttle opening at a finer level as compared with a case of the dot-dash lines based on the 8-bit resolution by adding computed values of the actual throttle opening. FIG. 6 shows actual throttle opening points supposed from the actual throttle opening shown in FIG. 4.

In FIG. 6, dot-dash lines indicate, in order from above, the opening values 81*h*, 80*h*, and 7Fh based on the 8-bit resolution, and a broken line indicates a boundary (½LSB) between *81*h and 80*h*. On the right-hand side of FIG. 6 are shown values based on a 10 bit resolution corresponding to the quotient of dividing the value of the 8-bit resolution by 4. These values are, in order from above, 204*h*, 203*h*, 202*h*, 201*h*, and 200*h*. The value 204*h* corresponds to the value 81*h* based on the 8-bit resolution, and the value 200*h* corresponds to the value 80*h* based on the 8-bit resolution. The results of computation of the actual throttle opening at certain times with intervals of 1 ms performed by the actual throttle opening computation means 10 are indicated below by solid lines. When the actual throttle opening exceeds the boundary between 81*h* and 80*h*, the value of the actual throttle opening computed by the actual throttle opening computation means 10 is 81*h*. When the actual throttle opening does not exceed the boundary, the computed value is 80*h*.

The computed values of the actual throttle opening are 80*h*, 81*h*, 81*h*, and 81*h*, which are the same as those shown in FIG. 4, and the totalized value is 203*h*. It can be understood that in this case the center (average) of the actual throttle opening is at 203*h* based on a 10-bit resolution. If a target throttle opening is 80*h* based on the 8-bit resolution and 200*h* based on the 10-bit resolution, computation is performed by using the control-use actual throttle opening 203*h* with respect to a supposed actual throttle opening point instead of the actual throttle opening computed values 80*h*, 81*h*, 81*h*, and 81*h*, which are 8-bit data; thus enabling computation of a motor control amount with improved accuracy. If the number of times the addition is performed is larger, it is possible to grasp the actual throttle opening state more accurately and to improve the accuracy of the supposed point.

As described above, actual throttle opening computed values are added up to improve the resolution and to improve the control accuracy of the throttle valve. Since computation in the CPU is performed in the binary notation, it is possible to obtain a resolution corresponding to the resolution of the A/D converter 9+n bits simply by setting the number of times the actual throttle opening is added to the nth power of 2. Thus, setting of the LSB of a target throttle opening, computation of a control-use actual throttle opening and computation of a throttle value control amount can be simplified.

For example, in a case where the number of times the actual throttle opening is added by the control-use actual throttle opening computation means 11 is set to 4 as in this embodiment, the improvement in resolution corresponds to 2 bits is achieved in which a control-use actual throttle opening is computed at a 10-bit resolution, and a target throttle opening can be set at a 10-bit resolution. Further, if the number of times the actual throttle opening is added is set to 8, the improvement in resolution corresponds to 3 bits is achieved in which a control-use actual throttle opening is computed at a 11-bit resolution, and a target throttle opening can be set at a 11-bit resolution.

Figure 7:
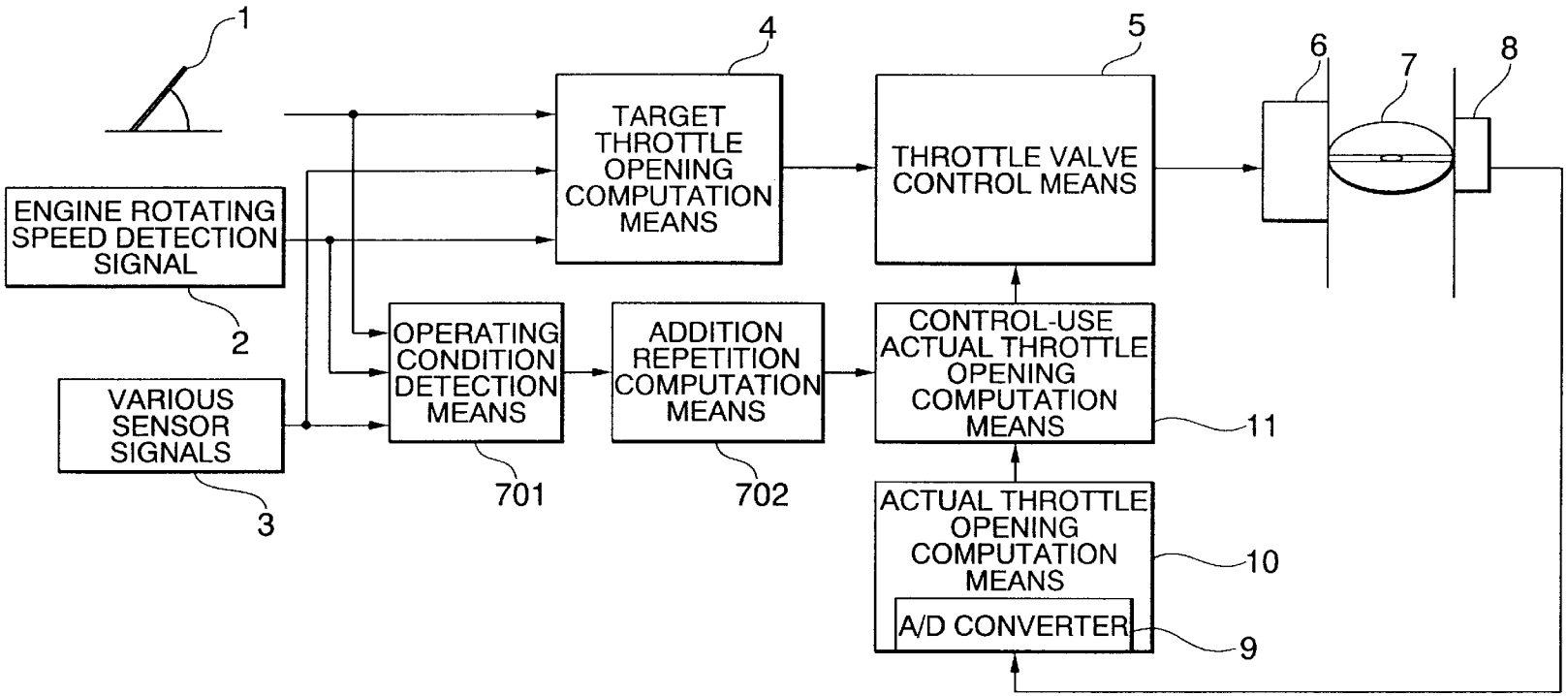
FIG. 7 is a diagram showing the configuration of an electronic throttle valve control apparatus in accordance with the embodiment of the invention having operating condition detection means and addition repetition computation means in addition to the components shown in FIG. 1.

Processing for changing the number of times the actual throttle opening is added is changed in the control-use actual throttle opening computation means 11 according to an engine operating condition will next be described. FIG. 7 shows an electronic throttle valve control apparatus. Operating condition detection means 701 for detecting an operating condition of an engine is supplied with an accelerator opening signal 1 indicating an accelerator operation performed by a driver, an engine speed detection signal indicating the engine rotating speed, and signals from various sensors 3 indicating conditions in the engine.

The operating condition detection means 701 detects an engine operating condition on the basis of these various input signals. Addition repetition computation means 702 for determining the number of times the actual throttle opening is added determines the number of times the actual throttle opening is added on the basis of the engine operating condition detected by the operating condition detection means 701. Control-use actual throttle opening computation means 11 computes a control-use actual throttle opening by adding, the number of times determined by the addition repetition computation means 702 and at certain time intervals, the actual throttle opening computed by actual throttle opening computation means 10.

Figure 8:
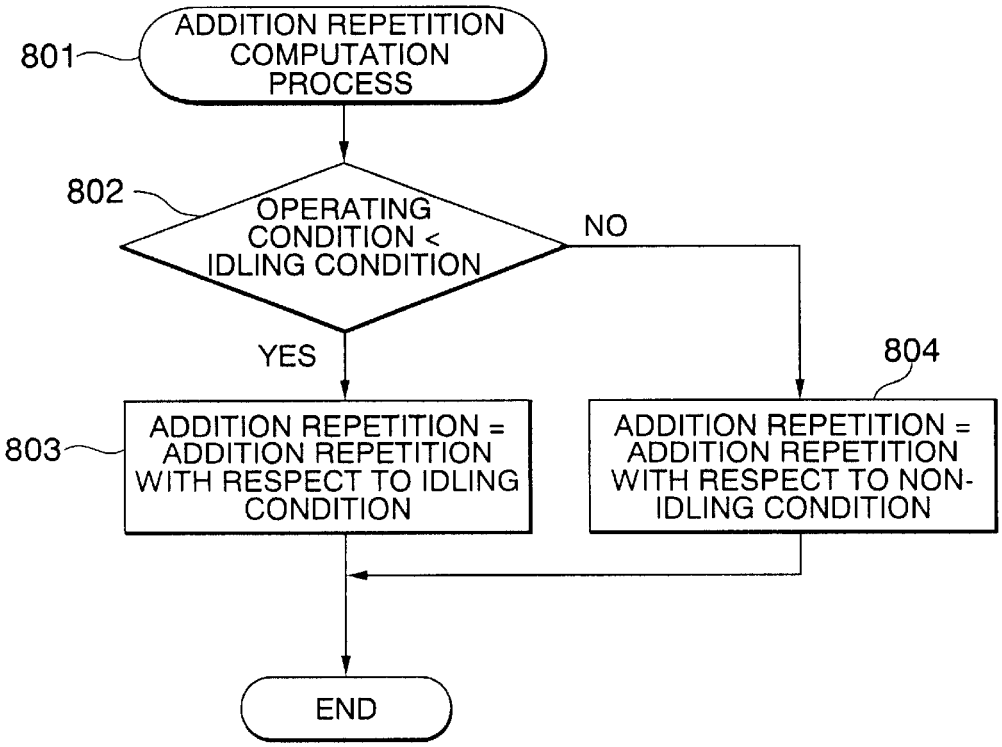
FIG. 8 is a flowchart of an addition repetition computation process in accordance with the embodiment of the invention.

The operating condition detection means 701 detects, for example, an idling condition of the engine. FIG. 8 shows a process performed by the addition repetition computation means 702 in a case where an idling condition of the engine is detected by the operating condition detection means 701. In step 802, through the addition repetition computation process (801), a determination is first made as to whether the operating condition detection means 701 detects the engine being in an idling condition. If the engine is in an idling condition, the process advances to step 803 and a number of addition repetition set with respect to the idling state is stored as the number of times the addition is performed. If it is determined in step S802 that the engine is not in an idling state, the process moves to step 804 and a number of addition repetition set with to non-idling conditions is stored as the number of times the addition is performed.

As described above, the number of times the actual throttle opening is added is changed according to an engine operating condition in such a manner that the number of addition repetition is increased when accurate throttle valve control is required as during idling, and the number of addition repetition is reduced to a smaller number or zero when accurate control is not necessary, for example, when the engine is operating in a state other than the idling state. Therefore, updated actual throttle opening information can be used to realize high-response motor control. It is also possible to reduce the load of control-use actual throttle opening computation.

According to the present invention, as described above, the actual throttle opening value detected by the actual throttle opening detection means is added a certain number of times by the control-use actual throttle opening computation means. As a result, the actual throttle opening can be detected at a high resolution at a low cost without requiring high-cost changes in hardware, e.g., the A/D converter, the sensors, and the input circuit; thus improving the accuracy with which the throttle opening is controlled.

Also, the control-use actual throttle opening is computed by adding the actual throttle opening detected value a number of times equal to the nth power of 2. As a result, a resolution can be increased n-bit by n-bit, and the setting of a target throttle opening and the computation for obtaining a throttle value control amount can be simplified.

Also, the number of times the actual throttle opening is added is changed according to the engine operating condition. As a result, a higher resolution can be achieved and the load of computation can be reduced.

Also, the number of times the actual throttle opening is added is selected from different numbers set in correspondence with the case where an engine idling condition is detected and the case where a non-idling condition is detected such that the number of addition repetition is increased when accurate throttle valve control is required, that is, when the engine is in the idling state, and the number of addition repetition is reduced when the engine is operating in a state other than the idling state. As a result, updated throttle opening information can be used for throttle valve control while reducing the load of computation.

Further, the detected value of the actual throttle opening may be added a certain number of times only when an engine idling condition is detected for computation of a control-use actual throttle opening. As a result, a higher resolution can be achieving while reducing the load of computation.

What is claimed is:

1. An apparatus for controlling an electronic throttle valve in which a throttle valve provided in a suction path of an engine is driven to be opened and closed by a motor, said apparatus comprising:

target throttle opening computation means for computing a target throttle opening of the throttle valve;

actual throttle opening detection means for detecting an actual opening of the throttle valve;

control-use actual throttle opening computation means for computing a control-use actual throttle opening by adding a predetermined number of times the actual throttle opening detected value obtained by said actual throttle opening detection means; and throttle valve control means for controlling the throttle valve on the basis of an opening deviation between the target throttle opening and the control-use actual throttle opening.

2. An apparatus according to claim 1, wherein said control-use actual throttle opening computation means computes the control-use actual throttle opening by adding the actual throttle opening detected value a number of times equal to the nth power of 2.

3. An apparatus according to claim 1, further comprising engine operating condition detection means for detecting an operating condition of the engine, wherein said control-use actual throttle opening computation means changes the number of times the actual throttle opening is added according to the engine operating condition detected by said engine operating condition detection means.

4. An apparatus according to claim 3, wherein an idling condition detection means is provided as said engine operating condition detection means, and wherein said control-use actual throttle opening computation means selects the number of times the actual throttle opening is added from different numbers set in correspondence with the case where an engine idling condition is detected and the case where a non-idling condition is detected.

5. An apparatus according to claim 4, wherein, only when an engine idling condition is detected by said idling condition detection means, said control-use actual throttle opening computation means computes a control-use actual throttle opening by adding a predetermined number of times the actual throttle opening value detected by said actual throttle opening detection means.

* * * * *